US011015500B2

(12) United States Patent
Chung et al.

(10) Patent No.: US 11,015,500 B2
(45) Date of Patent: May 25, 2021

(54) BLOW-BY GAS OIL SEPARATOR

(71) Applicants: HYUNDAI MOTOR COMPANY, Seoul (KR); KIA MOTORS CORPORATION, Seoul (KR)

(72) Inventors: Chung Soo Chung, Incheon (KR); Byung Ok Park, Hwaseong-Si (KP); Yoong Hwa Park, Seongnam-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 294 days.

(21) Appl. No.: 16/220,582

(22) Filed: Dec. 14, 2018

(65) Prior Publication Data

US 2020/0123943 A1 Apr. 23, 2020

(30) Foreign Application Priority Data

Oct. 19, 2018 (KR) ..... 10-2018-0125310

(51) Int. Cl.
*F01M 13/04* (2006.01)

(52) U.S. Cl.
CPC ..... *F01M 13/04* (2013.01); *F01M 2013/0433* (2013.01); *F01M 2013/0438* (2013.01)

(58) Field of Classification Search
CPC ..... F01M 13/04; F01M 13/0416; F01M 2013/0438; F01M 2013/0433; F02M 35/10222; F02D 2250/08; B01D 45/00; B01D 5/02; B01D 45/08; B01D 46/00; B01D 50/00; B01D 50/002
See application file for complete search history.

(56) References Cited

U.S. PATENT DOCUMENTS 5,242,475 A * 9/1993 Stine ..... B01D 46/0031 55/319
6,247,463 B1 * 6/2001 Fedorowicz ..... F02M 25/06 123/572
6,561,171 B2 * 5/2003 Burgess ..... F01M 13/04 123/572

(Continued)

FOREIGN PATENT DOCUMENTS

KR 10-1720557 B1 3/2017
KR 10-1822832 B1 1/2018

OTHER PUBLICATIONS

Machine translation, KR101720557B1, published Mar. 30, 2017, obtained from https://worldwide.espacenet.com/, pp. 1-11. (Year: 2017).*

(Continued)

*Primary Examiner* — Grant Moubry
(74) *Attorney, Agent, or Firm* — Morgan, Lewis & Bockius LLP

(57) ABSTRACT

A separator includes: a filter device that receives oil-containing blow-by gases from an engine and separates at least a portion of oil from the oil-containing blow-by gases, the oil-containing blow-by gases being generated by the engine; a screen extending from the filter device in a direction transverse to a vertical direction with respect to the engine; a drain hole vertically penetrating below the screen to allow the separated oil to be discharged by gravity; and a gas outlet disposed above the screen to discharge the separated blow-by gases.

10 Claims, 7 Drawing Sheets

(56) References Cited

U.S. PATENT DOCUMENTS

| | | | | |
|---|---|---|---|---|
| 8,113,185 | B2 * | 2/2012 | Song | F01M 13/0416 123/572 |
| 9,938,869 | B2 * | 4/2018 | Dwivedi | F01M 13/04 |
| 10,774,703 | B2 * | 9/2020 | Morishita | F01M 13/04 |
| 2018/0104630 | A1 * | 4/2018 | Miyanaga | B01D 46/003 |

OTHER PUBLICATIONS

Machine translation, KR101010540351B1, published Jan. 29, 2018, obtained from https://worldwide.espacenet.com/, pp. 1-6. (Year: 2018).*

* cited by examiner

BLOW-BY GAS OIL SEPARATOR

CROSS-REFERENCE TO RELATED APPLICATION

This application is claims the benefit of priority to Korean Patent Application No. 10-2018-0125310, filed in the Korean Intellectual Property Office on Oct. 19, 2018, the entire contents of which are incorporated herein by reference.

TECHNICAL FIELD

The present disclosure relates to a separator for separating oil from blow-by gases of a vehicle.

BACKGROUND

In general, blow-by gases generated in an engine flow into a crankcase, that is, an inner space between an engine block and an oil pan, and re-circulate to an intake system via a head cover. The blow-by gases refer to combustion gas leaking from a combustion chamber past pistons/piston rings and compressed air/exhaust gas leaking from the intake/exhaust sides of a turbo charger. If a large amount of oil is contained in the blow-by gases, the intake system may be contaminated and engine performance may be degraded by deposits. Therefore, a separator is installed in the head cover to separate and trap oil.

SUMMARY

The present disclosure has been made to solve the above-mentioned problems occurring in the prior art while advantages achieved by the prior art are maintained intact.

An aspect of the present disclosure provides a blow-by gas oil separator made shorter in length.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a separator includes: a filter device that receives oil-containing blow-by gases from an engine and separates at least a portion of oil from the oil-containing blow-by gases, the oil-containing blow-by gases being generated by the engine; a screen extending from the filter device in a direction transverse to a vertical direction with respect to the engine; a drain hole vertically penetrating below the screen to allow the separated oil to be discharged by gravity; and a gas outlet disposed above the screen to discharge the separated blow-by gases.

According to another aspect of the present disclosure, a separator includes: a filter device that receives oil-containing blow-by gases from an engine and separates at least a portion of oil from the oil-containing blow-by gases, the oil-containing blow-by gases being generated by the engine; a screen extending from the filter device in a direction transverse to a vertical direction with respect to the engine; a drain hole disposed upstream of the filter device along a reference direction in which the blow-by gases flow, the drain hole vertically penetrating to allow the separated oil to be discharged by gravity; an auxiliary drain hole vertically penetrating below the screen to allow the separated oil to be discharged by gravity; and a gas outlet disposed above the screen to discharge the separated blow-by gases.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
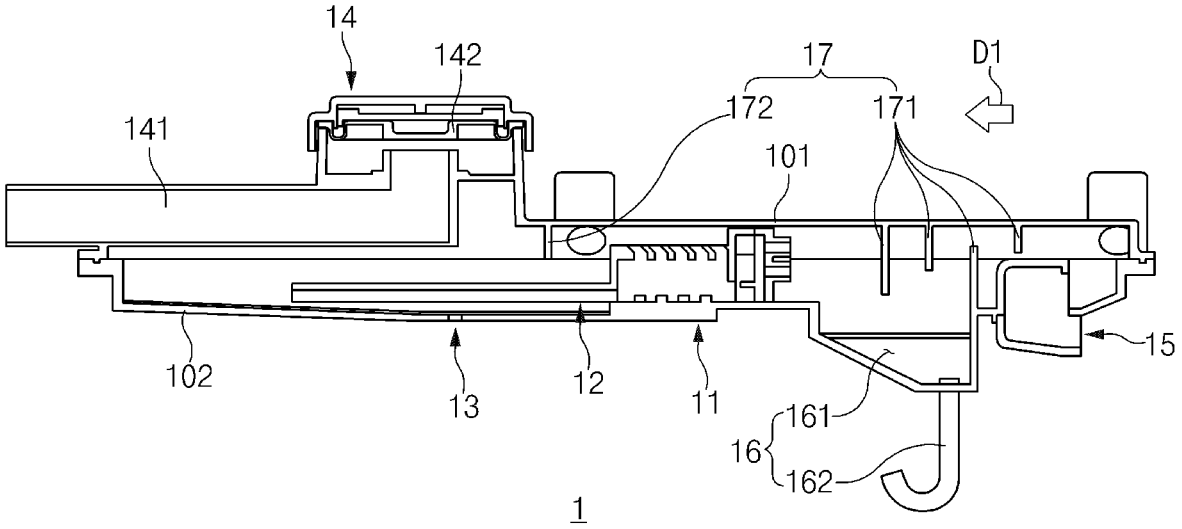
FIG. 1 is a longitudinal sectional view illustrating a separator according to an embodiment of the present disclosure.

Hereinafter, exemplary embodiments of the present disclosure will be described in detail with reference to the accompanying drawings. It should be understood that even if shown in different drawings, identical components are provided with identical reference numerals in the drawings. Furthermore, in describing the embodiments of the present disclosure, detailed descriptions related to well-known functions or configurations will be omitted when they may make subject matters of the present disclosure unnecessarily obscure.

Terms, such as "first", "second", "A", "B", "(a)", "(b)", and the like, may be used herein to describe components of the present disclosure. Such terms are only used to distinguish one component from another component, and the substance, sequence, order, or number of these components is not limited by these terms. If a component were described as "connected", "coupled", or "linked" to another component, they may mean the components are not only directly "connected", "coupled", or "linked" but also are indirectly "connected", "coupled", or "linked" via a third component.

FIG. 1 is a longitudinal sectional view illustrating a separator 1 according to an embodiment of the present disclosure.

Referring to FIG. 1, the separator 1 according to an embodiment of the present disclosure may include a filter device 11, a screen 12, a drain hole 13, and a gas outlet 14. The separator 1 may be used in a front engine-front drive (FF) type engine. The separator 1 may include an upper plate 101 and a lower plate 102 that are vertically assembled together to form a space inside. The term "reference direction D1" used herein means a direction in which blow-by gases flow in the entire interior of the separator 1 rather than a direction in which the blow-by gases locally flow. In FIG. 1, the reference direction D1 means a left direction that is one of perpendicular directions to a vertical direction. However, the reference direction D1 is not limited thereto. In various embodiments of the present disclosure, a front portion of the engine, which is an internal combustion engine, may be located upstream of the separator 1 with respect to the reference direction D1, and a rear portion of the engine may be located downstream of the separator 1.

Figure 2:
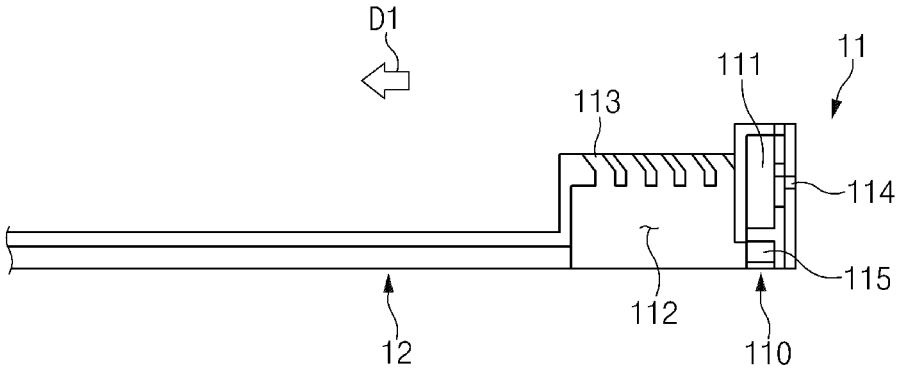
FIG. 2 is a longitudinal sectional view illustrating a filter device and a screen in the separator according to the embodiment of the present disclosure.
Figure 3:
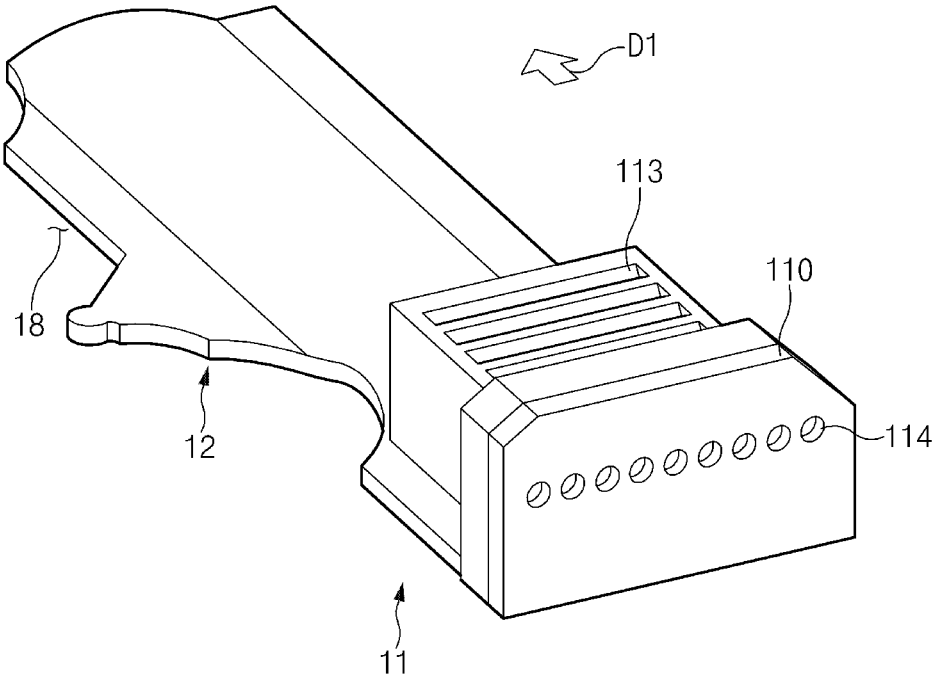
FIG. 3 is a perspective view illustrating the filter device and a portion of the screen in the separator according to the embodiment of the present disclosure.

FIG. 2 is a longitudinal sectional view illustrating the filter device 11 and the screen 12 in the separator 1 according to the embodiment of the present disclosure. FIG. 3 is a perspective view illustrating the filter device 11 and a portion of the screen 12 in the separator 1 according to the embodiment of the present disclosure.

The filter device 11 is a component that separates at least a portion of oil contained in blow-by gases. The filter device 11 receives the oil-containing blow-by gases from the internal combustion engine, which is connected to the separator 1, along the reference direction D1. The filter device 11 separates at least a portion of the oil from the received blow-by gases and sends out the blow-by gases with reduced oil content.

The filter device 11 may include a filter plate 110, a filter member 111, and a nozzle 113. The filter plate 110 is a component that the blow-by gases firstly meet. The filter plate 110 has a plurality of through-holes 114 that are open in the reference direction D1. The blow-by gases flow from one side to an opposite side of the filter plate 110 through the plurality of through-holes 114. That is, with respect to the reference direction D1, the one side of the filter plate 110 is an upstream side, and the opposite side of the filter plate 110 is a downstream side. While the plurality of through-holes 114 are arranged in a row as illustrated in FIG. 3, the arrangement and number of through-holes 114 are not limited thereto.

The filter member 111 is disposed on a filter support 115 located downstream of the filter plate 110 with respect to the reference direction D1. The filter member 111 may be a porous filter through which the blow-by gases can pass, but at least a portion of the oil contained in the blow-by gases cannot pass. However, the type of filter used as the filter member 111 is not limited thereto.

The blow-by gases passing through the filter member 111 flow into an inner space 112 of the filter device 11. The inner space 112 of the filter device 11 is an empty space located downstream of the filter member 111 with respect to the reference direction D1. The filter device 11 may include the nozzle 113 in communication with the inner space 112. The nozzle 113 may have a plurality of small openings and may be located at the top of the filter device 11. The openings of the nozzle 113 may extend in the vertical direction and then obliquely extend in a direction between the vertical direction and the reference direction D1. Since the openings of the nozzle 113 have a much smaller cross-sectional area than the inner space 112, the blow-by gases may be accelerated and discharged from the filter device 11 in the accelerated state.

The oil separated from the blow-by gases by the filter member 111 falls down the filter member 111 and flows toward the bottom of the inner space 112. The oil is discharged out of the filter device 11 through a filter discharge passage (not illustrated) that is formed adjacent to the bottom of the inner space 112 along the reference direction D1. The blow-by gases are discharged upward from the filter device 11 where possible, and the oil is discharged downward from the filter device 11 where possible. Accordingly, the blow-by gases and the oil are separated from each other and are not mixed with each other.

The screen 12 extends from the filter device 11 in a direction transverse to the vertical direction and spatially separates the blow-by gases and the separated oil. While the screen 12 is illustrated as extending in the separator 1 in the reference direction D1, the shape of the screen 12 is not limited thereto. While the screen 12 is illustrated as extending from a lower side of the filter device 11, the location from which the screen 12 extends is not limited thereto.

When the blow-by gases flow above the screen 12 and the oil flows below the screen 12, the screen 12 may prevent the oil from being raised by the momentum of the blow-by gases. Accordingly, the gas outlet 14 and the drain hole 13 may be located on the same line, or adjacent to each other, in the vertical direction, thereby reducing the overall length of the separator 1.

The screen 12 may be disposed so as not to make contact with an inner side of the separator 1 formed by the upper plate 101 and the lower plate 102. Accordingly, when the oil falls onto the top side of the screen 12, the oil may move below the screen 12 through an oil slit 18 formed between the inner side of the separator 1 and the screen 12. The top side of the screen 12 may be curved upward to allow the oil falling from above the screen 12 to slide along the top side of the screen 12 and to be guided into the drain hole 13, which is located below the screen 12, through the oil slit 18.

The drain hole 13 is a through-hole vertically formed below the screen 12 to allow the oil separated by the filter device 11 to be discharged by the weight thereof. The drain hole 13 may be formed in the lower plate 102 and may be connected with a pipe for discharging the oil.

A portion of an inner side of the lower plate 102 that is located around the drain hole 13 may be inclined toward the drain hole 13. Accordingly, when the oil falls onto the inner side of the lower plate 102, the oil may flow into the drain hole 13 due to the weight thereof.

The gas outlet 14 is disposed above the screen 12 to discharge the blow-by gases from which the oil is separated. Accordingly, the gas outlet 14 and the drain hole 13 are located above and below the screen 12 in the vertical direction, respectively. Since the blow-by gases are discharged to the outside through the gas outlet 14, a pipe for discharging the blow-by gases may be connected to the gas outlet 14.

A pressure valve 142 may be disposed in the gas outlet 14. The pressure valve 142 may be a positive crankcase ventilation (PCV) valve for adjusting the pressure in an engine ventilation system. The pressure valve 142 adjusts the flow of the blow-by gases discharged through the pressure valve 142 to maintain the pressure in an engine crankcase at constant pressure.

The gas outlet 14 may further include a gas passage 141 through which the blow-by gases flow and are guided to the outside.

Figure 4:
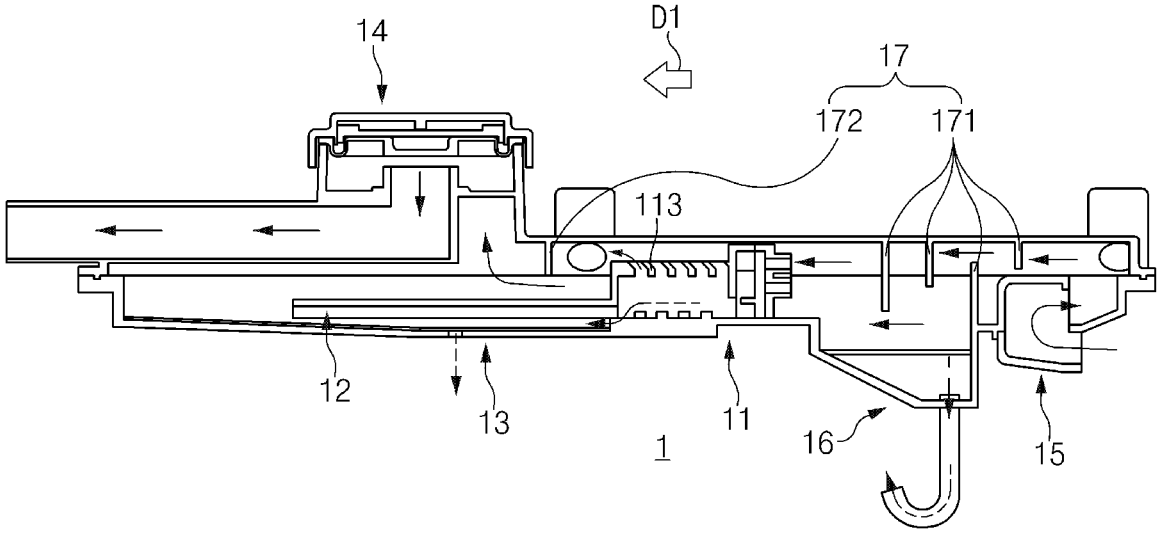
FIG. 4 is a longitudinal sectional view illustrating flow directions of oil and blow-by gases in the separator according to the embodiment of the present disclosure.

Hereinafter, flow directions of the oil and the blow-by gases in the separator 1 according to the embodiment of the present disclosure and other components included in the separator 1 will be described with reference to FIG. 4. FIG. 4 is a longitudinal sectional view illustrating the flow directions of the oil and the blow-by gases in the separator 1 according to the embodiment of the present disclosure. In FIG. 4, the flow of the blow-by gases is represented by solid arrows, and the flow of the oil is represented by dashed arrows.

The oil-containing blow-by gases generated in the engine flow into the separator 1 from the engine through an inlet 15. The passage in the inlet 15 may not be formed in a straight line, but may be crooked as illustrated in FIG. 4. The passage may have a section through which the blow-by gases flow in the opposite direction to the reference direction D1.

The blow-by gases flowing into the separator 1 through the inlet 15 are delivered to the filter device 11. While being delivered to the filter device 11, the blow-by gases may collide with front partition walls 171 formed in a direction transverse to the flow direction of the blow-by gases. Partition walls 17 may include the front partition walls 171 and a rear partition wall 172. The front partition walls 171 may be formed inside the separator 1 and may disrupt the flow of the blow-by gases. The front partition walls 171 may be formed on an inner side of the upper or lower plate 101 or 102 between the inlet 15 and the filter device 11. Due to the collision of the blow-by gases with the front partition walls 171, the oil may be separated from the blow-by gases and may be attached to the front partition walls 171. The oil attached to the front partition walls 171 may fall downward in the vertical direction due to the weight thereof.

The oil falling from the front partition walls 171 may be stored in a chamber 161. The chamber 161 may be in communication with an auxiliary drain hole 16 formed through the lower plate 102, and the oil stored in the chamber 161 may be discharged through the auxiliary drain hole 16. The chamber 161 may be inclined toward the auxiliary drain hole 16.

A siphon pipe 162 for discharging the oil using the siphon principle may be connected to the auxiliary drain hole 16. The siphon pipe 162 in a "J" shape stores the oil in the lowermost portion thereof and causes all the oil stored in the siphon pipe 162 to be discharged by the siphon principle when the oil stored in the siphon pipe 162 reaches a predetermined level. The siphon pipe 162 enables the auxiliary drain hole 16 to discharge the oil more easily.

The blow-by gases from which at least a portion of the oil is separated flow along the reference direction D1 and are delivered to the filter device 11. The blow-by gases flow into the through-holes 114, and at least a portion of the oil is separated from the blow-by gases by the filter member 111. The blow-by gases flow into the inner space 112 of the filter device 11 and are discharged upward through the nozzle 113, and the oil flows along the bottom of the inner space 112 and flows into the drain hole 13.

The blow-by gases discharged through the nozzle 113 may collide with a rear partition wall 172 disposed on the inner side of the upper or lower plate 101 or 102 between the filter device 11 and the gas outlet 14. The rear partition wall 172, which a kind of partition wall, may be formed in the direction transverse to the reference direction D1, similarly to the front partition walls 171. Furthermore, likewise to the front partition walls 171, the rear partition wall 172 is disposed such that the oil is separated by the collision of the blow-by gases with the rear partition wall 172. Accordingly, the oil may be separated by the rear partition wall 172 and may fall onto a region adjacent to the drain hole 13. The oil falling from the rear partition wall 172 may directly fall onto the region adjacent to the drain hole 13, or may fall onto the screen 12 and then flow into the oil slit 18 along the screen 12. The oil collected in the region adjacent to the drain hole 13 may be discharged out of the separator 1 through the drain hole 13 by the weight thereof.

The blow-by gases from which at least a portion of the oil is separated flow above the screen 12 and are discharged to the gas outlet 14 through the pressure valve 142. The gas passage 141 in the gas outlet 14 may not be formed simply in a straight line, but may have an L shape as illustrated in FIG. 4.

Figure 5:
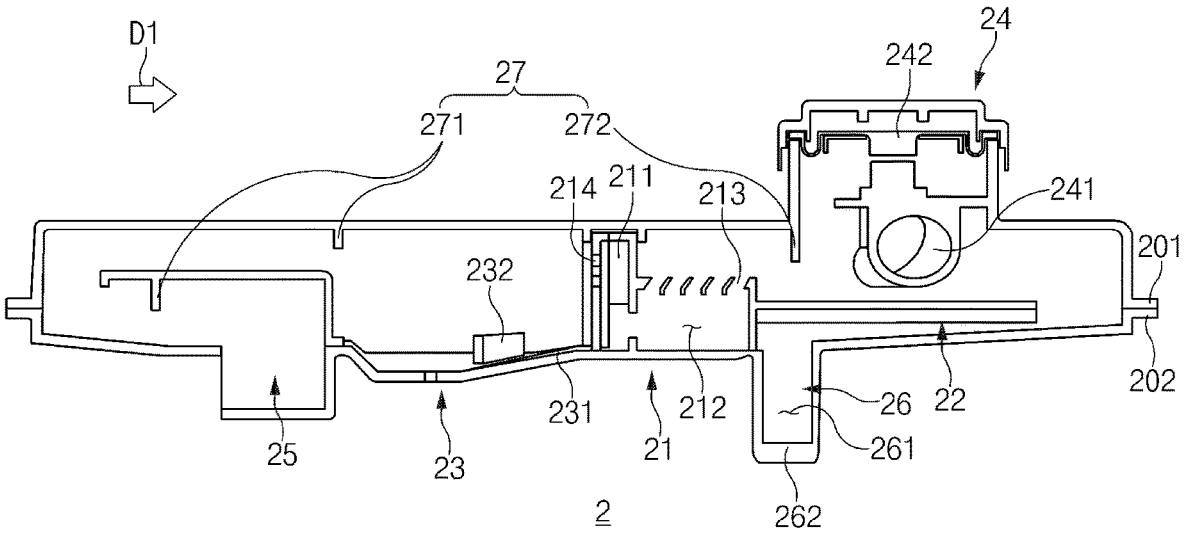
FIG. 5 is a longitudinal sectional view illustrating a separator according to another embodiment of the present disclosure.
Figure 6:
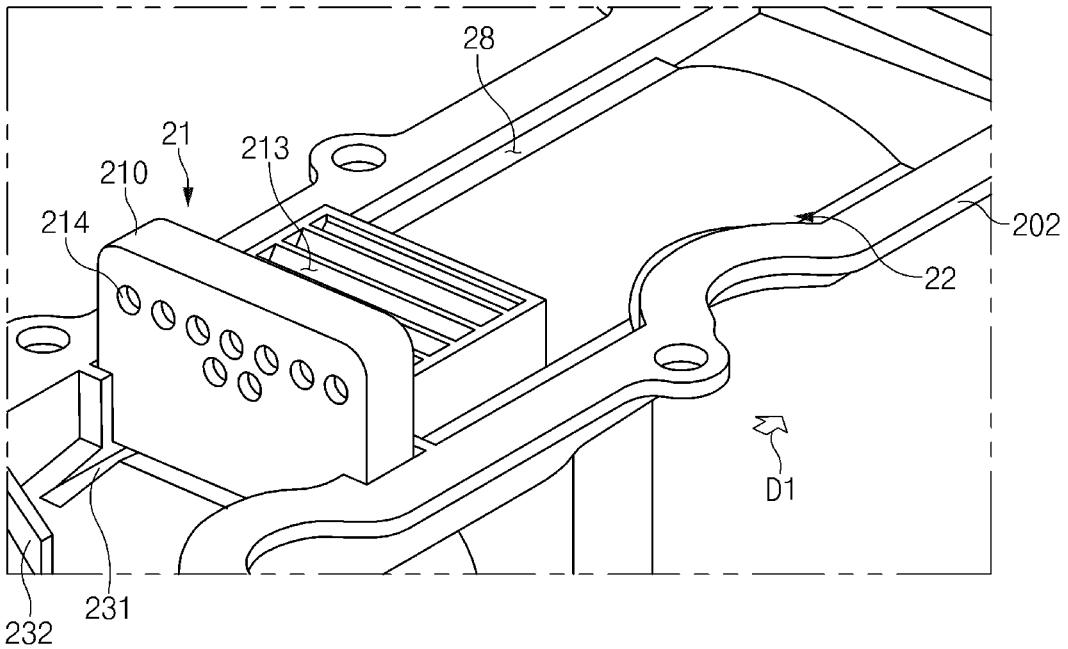
FIG. 6 is a perspective view illustrating a filter device and a portion of a screen in the separator according to another embodiment of the present disclosure.

FIG. 5 is a longitudinal sectional view illustrating a separator 2 according to another embodiment of the present disclosure. FIG. 6 is a perspective view illustrating a filter device 21 and a portion of a screen 22 in the separator 2 according to another embodiment of the present disclosure.

The separator 2 according to another embodiment of the present disclosure may be used in an engine of a front engine-rear drive (FR) type. In another embodiment of the present disclosure, the rear of the engine is located upstream of the separator 2 with respect to a reference direction D1, and the front of the engine is located downstream of the separator 2. In FIG. 5 illustrating another embodiment of the present disclosure, the reference direction D1 is the right direction. However, the reference direction D1 is not limited thereto.

Components of the separator 2 according to another embodiment of the present disclosure that are not separately described have the same forms and functions as those of the separator 1 according to the embodiment of the present disclosure. Therefore, descriptions of these components are replaced with the descriptions of the embodiment of the present disclosure.

In the separator 2 according to another embodiment of the present disclosure, a drain hole 23 is not located below the screen 22, but upstream of the filter device 21 with respect to the reference direction D1. Therefore, an oil groove 231 and an oil guide 232 are disposed to guide oil separated by the filter device 21 toward the upstream side of the filter device 21. The oil groove 231 is a flow passage concavely formed on an inner side of a lower plate 202. The oil guide 232 is formed in a wing shape such as a flap and is seated on the inner side of the lower plate 202. The oil guide 232 is arranged in a direction toward the drain hole 23 to allow the oil to flow toward the drain hole 23. The oil groove 231 and the oil guide 232 are located adjacent to each other and guide the oil into the drain hole 23.

The separator 2 according to another embodiment of the present disclosure has an auxiliary drain hole 26 below the screen 22. Therefore, a chamber 261 for collecting falling oil and a check valve 262 may be disposed below the screen 22. The check valve 262 may be opened to discharge the oil collected in the chamber 261 to the outside of the separator 2 and may be closed to store the oil in the chamber 261. Since a differential pressure between the inside and outside of the separator 2 is greater at the rear end of the separator 2, which is a downstream side with respect to the reference direction D1, than at an inlet 25, the auxiliary drain hole 26, along with these components, prevent a reverse flow of the oil. Furthermore, since the oil separated at the rear end of the separator 2 has a relatively small particle size and is small in quantity, the check valve 262 may be used.

In another embodiment of the present disclosure, the filter device 21 may have two rows of through-holes 214 as illustrated in FIG. 6, in which a different number of through-holes 214 may be arranged in each row. However, the arrangement and number of through-holes 214 are not limited to those illustrated in FIG. 6.

Figure 7:
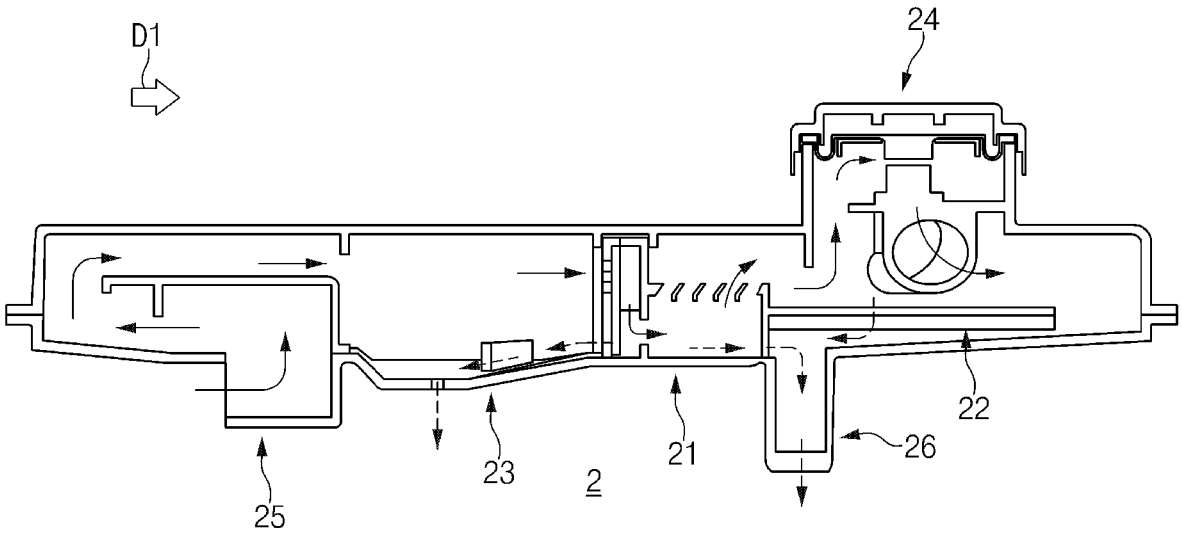
FIG. 7 is a longitudinal sectional view illustrating flow directions of oil and blow-by gases in the separator according to another embodiment of the present disclosure.

Hereinafter, flow directions of oil and blow-by gases in the separator 2 according to another embodiment of the present disclosure and other components included in the separator 2 will be described with reference to FIG. 7. FIG. 7 is a longitudinal sectional view illustrating the flow directions of the oil and the blow-by gases in the separator 2 according to another embodiment of the present disclosure. In FIG. 7, the flow of the blow-by gases is represented by solid arrows, and the flow of the oil is represented by dashed arrows.

The oil-containing blow-by gases flow into the separator 2 from an internal combustion engine through the inlet 25. The passage in the inlet 25 may not be in a straight line, but may be crooked as illustrated in FIG. 7. The passage may have a section through which the blow-by gases flow in the opposite direction to the reference direction D1. Furthermore, front partition walls 271 may be formed in the inlet 25.

The blow-by gases flowing into the separator 2 through the inlet 25 are delivered to the filter device 21. While being delivered to the filter device 21, the blow-by gases may collide with the front partition walls 271 formed in a direction transverse to the reference direction D1. Partition walls 27 may include the front partition walls 271 and a rear partition wall 272. The oil attached to the front partition walls 271 may fall downward in the vertical direction due to the weight thereof.

The oil falling from the front partition walls 271 may be discharged through the drain hole 23. A region of the lower plate 202 that is adjacent to the drain hole 23 may be inclined toward the drain hole 23 to allow the oil falling from the front partition walls 271 to collect into the drain hole 23.

The blow-by gases from which at least a portion of the oil is separated flow along the reference direction D1 and are delivered to the filter device 21. The blow-by gases flow into the through-holes 214, and at least a portion of the oil is separated from the blow-by gases by a filter member 211. The blow-by gases flow into an inner space 212 of the filter device 21 and are discharged upward through a nozzle 213, and the oil flows along the bottom of the inner space 212 and moves to the drain hole 23 and the auxiliary drain hole 26. The oil escapes from the filter device 21 and flows toward the drain hole 23 through the oil groove 231 and the oil guide 232 in the opposite direction to the reference direction D1.

The blow-by gases discharged through the nozzle 213 may collide with a rear partition wall 272 disposed on an inner side of an upper plate 201 between the filter device 21 and a gas outlet 24. The oil may be separated by the rear partition wall 272 and may fall onto a region adjacent to the auxiliary drain hole 26. The oil may directly fall onto the region adjacent to the drain hole 26, or may fall onto the screen 22 and then flow into an oil slit 28 along the screen 22. The oil collected in the region adjacent to the auxiliary drain hole 26 may be discharged out of the separator 2 through the auxiliary drain hole 26 by the weight thereof.

The blow-by gases from which at least a portion of the oil is separated flow above the screen 22 and are discharged to the gas outlet 24 through a pressure valve 242.

According to the embodiments of the present disclosure, the drain hole for discharging oil and the gas outlet may be located on the same line, thereby reducing the length of the separator.

Hereinabove, even though all of the constituent components are coupled into one body or operate in a combined state in the description of the above-mentioned embodiments of the present disclosure, the present disclosure is not limited to these embodiments. That is, all of the constituent components may operate in one or more selective combination within the range of the purpose of the present disclosure. It should be also understood that the terms of "include", "comprise" or "have" in the specification are "open type" expressions just to say that the corresponding constituent components exit and, unless specifically described to the contrary, do not exclude but may include additional components. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

What is claimed is:

1. A separator comprising:

a filter device configured to receive oil-containing blow-by gases from an engine and to separate at least a portion of oil from the oil-containing blow-by gases, wherein the oil-containing blow-by gases are generated by the engine;

a screen extending from the filter device in a direction transverse to a vertical direction with respect to the engine;

a drain hole vertically penetrating below the screen to allow the separated oil to be discharged by gravity; and a gas outlet disposed above the screen to discharge the separated blow-by gases, wherein the drain hole and the gas outlet are arranged above and below the screen, respectively, to be vertically aligned and face each other.

2. The separator of claim 1, wherein the filter device includes:

a filter plate having a plurality of through-holes; and a filter member located downstream of the filter plate with respect to a reference direction in which the blow-by gases flow, the filter member configured to prevent at least a portion of the oil contained in the blow-by gases from passing through the filter member when the blow-by gases pass through the filter member.

3. The separator of claim 2, wherein the filter device further includes a nozzle configured to accelerate the blow-by gases passing through the filter member and to discharge the accelerated blow-by gases.

4. The separator of claim 1, further comprising:

an inlet configured to deliver the oil-containing blow-by gases, which are received from the engine, to the filter device;

a front partition wall disposed between the inlet and the filter device in a direction transverse to a reference direction in which the blow-by gases flow; and an auxiliary drain hole configured to discharge the oil that flows downward due to a collision of the blow-by gases with the front partition wall.

5. The separator of claim 4, wherein a siphon pipe is connected to the auxiliary drain hole to discharge the oil by a practical siphon.

6. The separator of claim 4, further comprising:

a chamber located below the front partition wall to store the falling oil and to discharge the stored oil through the auxiliary drain hole.

7. The separator of claim 1, further comprising:

a rear partition wall disposed between the filter device and the gas outlet to allow the oil to flow down onto a region adjacent to the drain hole due to a collision of the blow-by gases with the rear partition wall.

8. The separator of claim 1, wherein a top side of the screen is curved upward to allow the oil flowing from above the screen to slide along the top side of the screen and to be guided into the drain hole.

9. The separator of claim 1, wherein a pressure valve is disposed in the gas outlet to maintain pressure in an engine crankcase at constant pressure.

10. A separator comprising:

a filter device configured to receive oil-containing blow-by gases from an engine and to separate at least a portion of oil from the oil-containing blow-by gases, wherein the oil-containing blow-by gases are generated by the engine;

a screen extending from the filter device in a direction transverse to a vertical direction with respect to the engine;

a drain hole disposed upstream of the filter device along a reference direction in which the blow-by gases flow, the drain hole vertically penetrating to allow the separated oil to be discharged by gravity;

an auxiliary drain hole vertically penetrating below the screen to allow the separated oil to be discharged by gravity; and a gas outlet disposed above the screen to discharge the separated blow-by gases, wherein the drain hole and the gas outlet are arranged above and below the screen, respectively, to be vertically aligned and face each other.

* * * * *